US005481348A

United States Patent [19]

Mihara et al.

[11] Patent Number: 5,481,348

[45] Date of Patent: Jan. 2, 1996

[54] DISCHARGE DEVICE FOR USE IN AN IMAGE FORMING APPARATUS CAPABLE OF CORRECTING A WARP ON COPY ITEMS PASSED THROUGH FIXING ROLLERS

[75] Inventors: Takashi Mihara; Kazumi Shirasaka; Kenji Oda; Akinobu Nakahata; Masahiro Shinohara; Wataru Sasaki, all of Osaka, Japan

[73] Assignee: Mita Industrial Co., Ltd., Osaka, Japan

[21] Appl. No.: 130,222

[22] Filed: Oct. 1, 1993

[30] Foreign Application Priority Data

Oct. 6, 1992 [JP] Japan ..... 4-267478

[51] Int. Cl.[6] ..... G03G 15/00

[52] U.S. Cl. ..... 335/290; 355/309; 355/321; 271/2; 271/207

[58] Field of Search ..... 355/282, 285, 355/309, 321; 271/2, 272, 207, 209

[56] References Cited

U.S. PATENT DOCUMENTS 5,069,439 12/1991 Sellers ..... 271/2

FOREIGN PATENT DOCUMENTS 59-198238 11/1984 Japan ..... 271/272
60-171963 9/1985 Japan ..... 271/207
1-214566 8/1989 Japan ..... 271/209
5-132214 5/1993 Japan ..... 271/272

*Primary Examiner*—Joan H. Pendegrass
*Attorney, Agent, or Firm*—Jordan and Hamburg

[57] ABSTRACT

A discharge device is usable for an image forming apparatus including a fixing portion having a heating roller in the shape of a hyperboloid for fixing a toner image formed on an envelope having a turned-up portion, and a stacking portion for stacking envelopes. The discharge device provided with a discharge roller system provided between the fixing portion and the stacking portion to discharge the envelope to the stacking portion has a upright portion provided near the discharge roller system below the transport path of the envelope to prevent the turned-up portion of the envelope from warping downward. This discharge device prevents a discharging envelope from coming into contact or colliding with the uppermost one of a stack of already discharged envelopes on the stacking portion, and enables the envelopes to be discharged suitably and to be stacked orderly on the stacking portion and increases an amount of envelopes stacked on the stacking portion.

8 Claims, 4 Drawing Sheets

DISCHARGE DEVICE FOR USE IN AN IMAGE FORMING APPARATUS CAPABLE OF CORRECTING A WARP ON COPY ITEMS PASSED THROUGH FIXING ROLLERS

BACKGROUND OF THE INVENTION

The present invention relates to a discharge device for use in an image forming apparatus which discharges a copy item bearing an image fixed thereto to a stacking portion and , particularly to a discharge device capable of discharging envelopes suitably when the envelopes are used as a copy item.

In an image forming apparatus such as a printer and a copying machine, a copy item is discharged to a stacking portion through a discharge guide after a toner image transferred thereto is heated and fused to be fixed thereon by a fixing device including a heating roller and a pressing roller. As a heating roller is used the one in the shape of a one-item hyperboloid since normal sheets are usually used as a copy sheet. The use of this heating roller prevents effectively the production of creases in the normal sheets.

However, there has been the following drawback. The heating roller is in the shape of a hyperboloid. Accordingly, the heating roller has a different rotating speed thereof at a circumferential surface (hereinafter referred to as a circumferential speed) when the copy item passes the fixing roller device. In other words, the closer to the widthwise center of the heating roller, the slower the circumferential speed. When the item passes the fixing roller device, the speed at which the item is transported by the fixing roller device differs in the widthwise direction. As a result, front and rear faces of a portion of the item are transported at different speeds because the pressing roller is cylindrical and the circumferential speed thereof is uniform in the widthwise direction. This will cause the item to warp at this portion. This warp has caused the problems that the item being discharged and stacked on the stacking portion located right downstream thereof comes into contact or collision with the uppermost one of a stack of already discharged items on the stacking portion to disorder or scatter the stack, or causes a jam.

In particular, these problems likely occur in image forming apparatuses recently proposed in which, besides the normal sheets, envelopes are used as copy item and are transported along a single transport path or transported side by side along a plurality of transport paths, and data such as addresses and names are copied or printed on these envelopes. Specifically, in the apparatuses of this type, envelops are set in a cassette for containing the envelopes therein so that turned-up portions of the envelopes are positioned at one side of the cassette with respect to a widthwise direction. The heating roller is in the shape of a hyperboloid, respective side end portions of the envelope in the widthwise direction are positioned at corresponding positions at which the heating roller has a different rotating speed thereof at a circumferential surface when the envelope passes the fixing roller device. Because of the two factors mentioned above, when the envelope passes the fixing roller device, the speed at which the envelope is transported by the fixing roller device differs in the widthwise direction. As a result, front and rear faces of a portion of the envelope including the turned-up portion are transported at different speeds because the pressing roller is cylindrical and the circumferential speed thereof is uniform in the widthwise direction. When this happens, the front and rear faces of the turned-up portion, which are relatively free to move, shift from each other, thereby causing the envelope to warp at this portion.

SUMMARY OF THE INVENTION

In view of the problems residing in the prior art, it is an object of the present invention to provide a discharge device which has a member for correcting a warp produced at a lateral edge of a copy item such as envelope, thereby enabling the items to be discharged suitably and to be stacked orderly on a stacking portion and increasing an amount of items stacked on the stacking portion.

According to the invention, a discharge device for use in an image forming apparatus including a fixing portion having a heating roller in the shape of a hyperboloid for fixing an image formed on an item and a stacking portion for stacking the item, the discharge device comprises discharge means provided between the fixing portion and the stacking portion and adapted for discharging the item to the stacking portion; and preventing means provided near the discharge means and below the item being discharged, and adapted for preventing the discharging item from warping downward.

It may be preferable that the preventing means is formed with an upright portion extending above a level of the item being discharged.

Also, it may be preferable to further provide a guide base portion for guiding the item from the fixing portion to the discharge means, the guide base portion being connected with the upright portion.

Further, it may be appropriate that the guide base portion is formed with a plurality of spaces at a specified interval in a horizontal direction perpendicular to the item discharging direction, and the discharge means is constructed by a drive shaft disposed above the guide base portion in a direction perpendicular to the item discharging direction, a plurality of drive rollers mounted on the drive shaft at the same interval as the spaces, and a plurality of driven rollers disposed in the spaces of the guide base portion respectively corresponding to the plurality of drive rollers.

Further, it may be appropriate that the discharge means is constructed by a drive shaft disposed below the item being discharged and having a plurality of drive rollers thereon at a specified interval, and the preventing means includes a disk mounted on the drive shaft, the disk having a diameter larger than that of the drive roller.

Furthermore, it may be appropriate that the discharge device is used in an image forming apparatus capable of forming images on envelopes being transported parallel to each other at the same time, the envelope having a turned-up portion.

The above and other objects features and advantages of the present invention will become more apparent upon a reading of the following detailed description and drawings.

DETAILED DESCRIPTION OF THE PREFERRED EMBODIMENTS OF THE INVENTION

Figure 1:
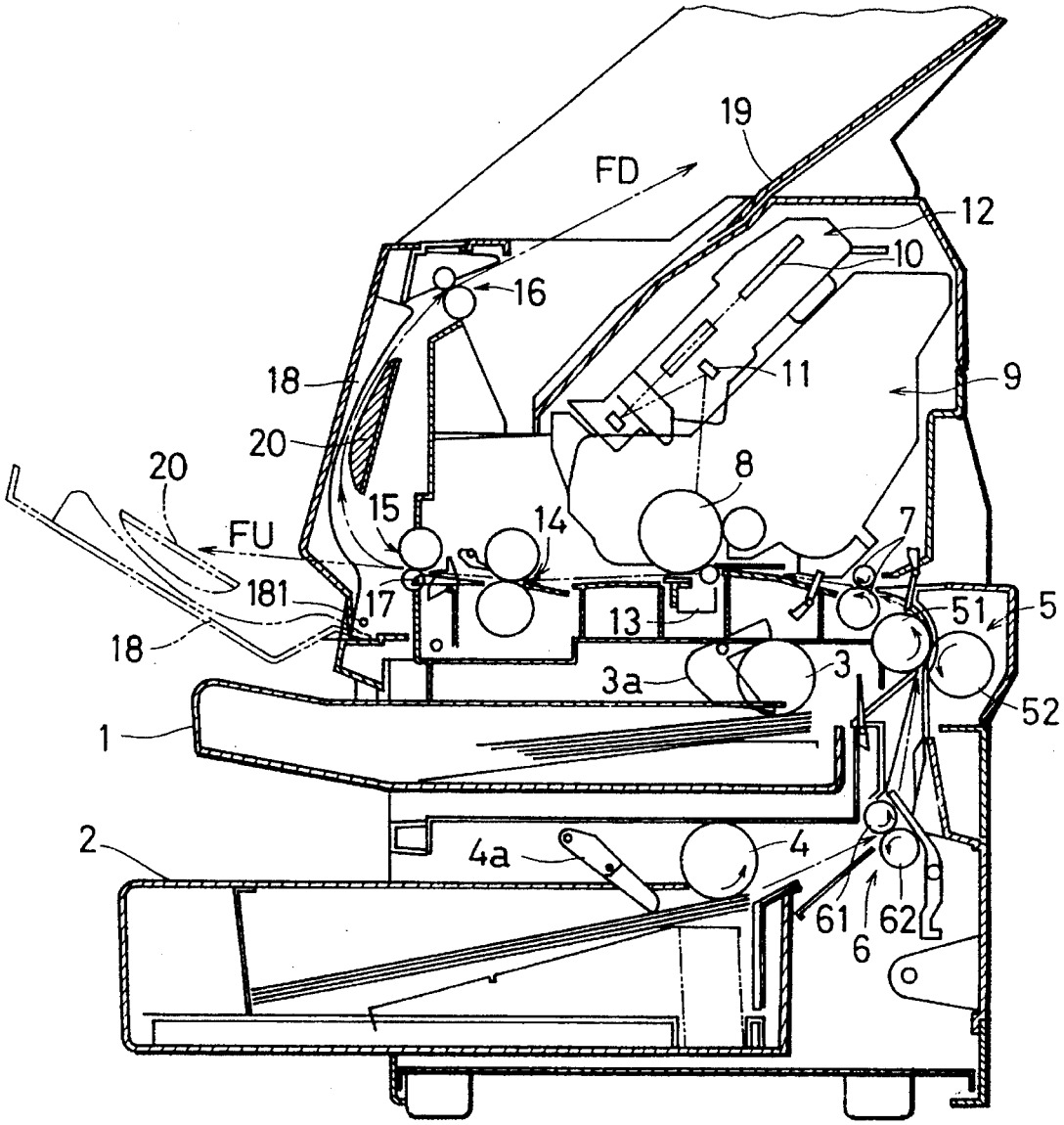
FIG. 1 is a sectional diagram showing an overall construction of an exemplary image forming apparatus incorporating a discharge device according to the invention.

FIG. 1 is a sectional diagram showing an overall construction of an exemplary image forming apparatus incorporating a discharge device according to the invention.

Cassettes 1, 2 for containing copy items are mounted vertically and detachably on this apparatus. Normal copy sheets are contained in the cassette 1, whereas a plurality of stacks of envelops are contained side by side in the cassette 2. In this embodiment, two stacks of envelops are contained in the cassette 2 and the envelops are stacked such that turned-up portions are located at one predetermined side with respect to a widthwise direction (see envelopes P1, P2 in FIG. 6). When the cassette 2 is selected, two envelopes are fed therefrom side by side simultaneously.

Indicated at 3, 4 are feed rollers which are located respectively above downstream ends of the cassettes 1, 2 with respect of an item transport direction to feed the copy items from the cassettes 1, 2. Indicated at 3*a*, 4*a* are cassette sensors respectively for detecting the presence or absence of the copy items in the cassettes 1, 2. A first separating device 5 including a forward roller 51 and a reverse roller 52 is disposed downstream from the cassette 1, and a second separating device 6 including a forward roller 61 and a reverse roller 62 is disposed downstream from the cassette 2. The usual copy sheets from the cassette 1 are transported to a pair of registration rollers after being separated by the first separating device 5. On the other hand, the envelopes from the cassette 2 are separated by the second separating device 6 and are transported to the registration rollers 7 through the first separating device 5 controlled so that the rollers 51, 52 are brought into idly rotatable state.

Downstream from the registration rollers 7 is arranged an imaging unit 9 including integrally a photosensitive member 8, a charger, a developing device, a cleaning device, etc. Around the imaging unit 9 are arranged an optical unit 12 including a light emitter 10 and a polygonal mirror 11, a transfer device 13, and the like. At a further downstream side, there are arranged a fixing device 14, discharge roller devices 15, 16, discharge guides 17, 18 for guiding the items being discharged, discharge trays 19, 20 as stacking portions and the like. The copy items are discharged onto the discharge tray 19 with face down (hereinafter referred to as FD discharge). The discharge guide 18 and the discharge tray 20 are formed integrally and are rotatable about a support shaft 181. The discharge tray 20 is set in a position indicated by solid line in the case of the FD discharge while being set in a position indicated by phantom line when the copy item is discharged with face up (hereinafter referred to as FU discharge). In this image forming apparatus, image data transferred internally or externally is introduced to the optical unit 12 and an image is formed in the imaging unit 9 by sending a modulated light from the light emitter 10.

Figure 2:
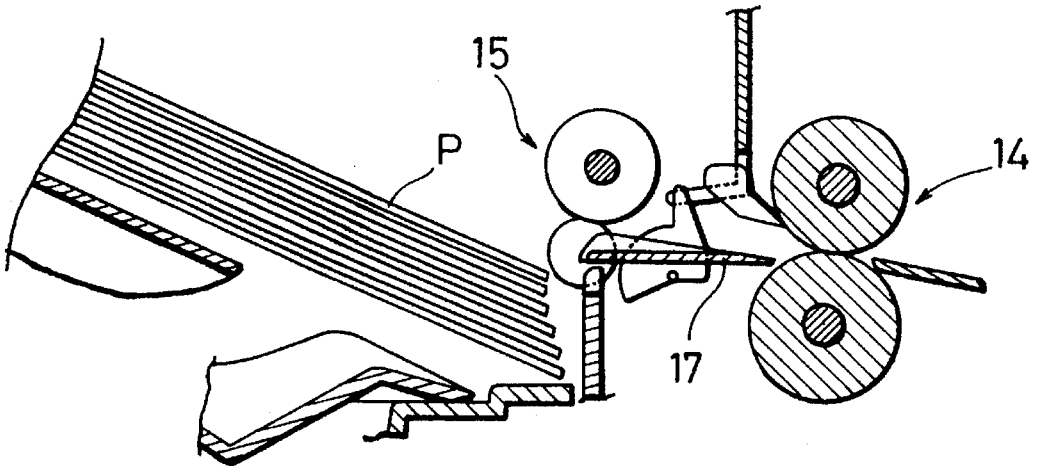
FIG. 2 is a diagram showing a stack of already discharged copy items on a stacking portion.

FIG. 2 is a diagram showing a stack of already discharged copy items on the discharge tray 20 when the envelopes are discharged with face up. As shown in this figure, the discharge tray 20 is disposed right downstream from the discharge roller device 15. The discharged copy items are stacked up one over another in an orderly manner on the discharge tray 20.

Figure 3:
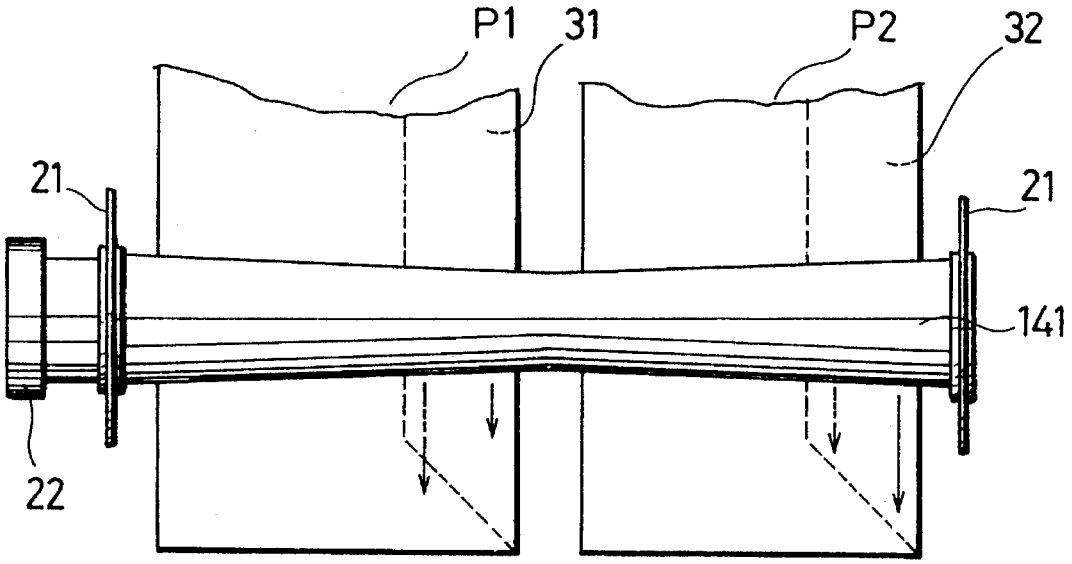
FIG. 3 is a diagram showing a state where the copy items are transported through a fixing device.
Figure 4:
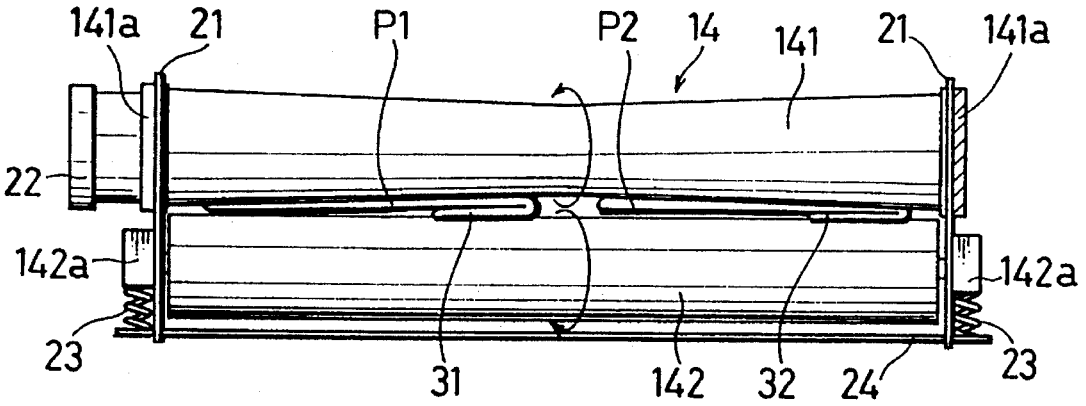
FIG. 4 is a diagram showing a state when leading edge portions of the copy items pass through the fixing device.
Figure 5:
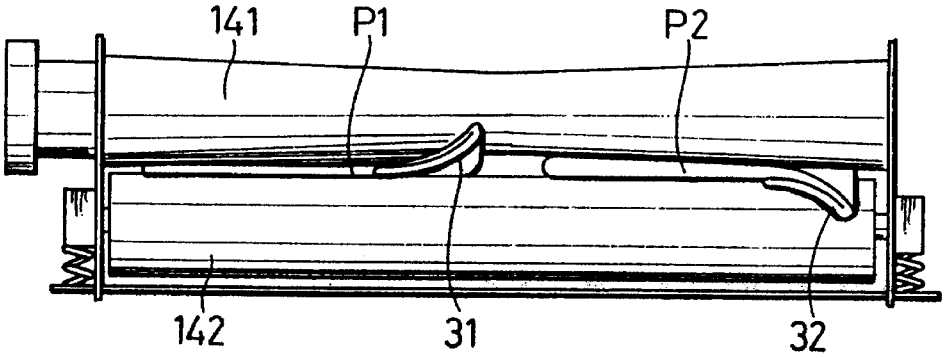
FIG. 5 is a diagram showing a state where the leading edge portions of the copy items come out of the fixing device.

FIGS. 3 to 5 are diagrams showing how the envelopes are transported through the fixing device. FIG. 4 shows a state when leading edge portions of the envelopes pass through the fixing device, and FIG. 5 shows a state where the leading edge portions of the envelopes come out of the fixing device.

The fixing device 14 includes a heating roller 141 and a pressing roller 142. These rollers 141. 142 are arranged in parallel while being supported rotatably through bearings 141*a*, 142*a* by side plates 21 of the apparatus main body. The heating roller 141 is coupled with an unillustrated drive means through a gear 22 and is provided internally with a heater (not shown). The heating roller 141 heats and fuses the toner image transferred to the copy item so as to fix the same on the copy item. The pressing roller 142 is biased toward the heating roller 141 by springs 23 provided between a bottom plate 24 of the apparatus main body and the bearings 142*a*, and is rotated together with the heating roller while being pressed against the same at specified pressure. The pressing contact of the pressing roller 142 with the heating roller 141 ensures the reliable fixing effect.

The heating roller 141 is of the one-item hyperboloid shape in which a diameter of a widthwise center portion is smaller than that of a widthwise periphery portion. The heating roller 141 of this shape prevents effectively the production of creases when the normal copy sheet passes through the fixing device. On the other hand, when two envelopes P1, P2 are transported side by side, these envelopes pass respectively through left and right halves of the space between the heating roller 141 and the pressing roller 142 as shown in FIG. 3. Thus, the circumferential speed of the heating rollers differs in the widthwise direction of the envelopes P1, P2.

There will be described a warp produced due to a difference in the circumferential speed. In FIG. 3, the solid line arrows indicate a transported amount of the front face of the envelopes, whereas the dashed line arrows indicate a transported amount of the rear face of the envelopes.

With respect to the envelope P1, a portion thereof in contact with a left side of the heating roller 141 is transported faster than a portion thereof in contact with the center portion of the heating roller 141. Thus, a lateral edge of a turned-up portion 31 where front and rear faces of the envelope are relatively free to shift to each other is warped upward due to a difference in the transport amount resulting from the circumferential speed difference. With respect to the envelope P2, a portion thereof in contact with a right side of the heating roller 141 is transported faster than a portion thereof in contact with the center portion of the heating roller 141. Thus, a lateral edge of a turned-up portion 32 is warped downward due to the difference in the transport amount resulting from the circumferential speed difference. FIG. 5 shows these states of the envelopes P1, P2.

Figure 6:
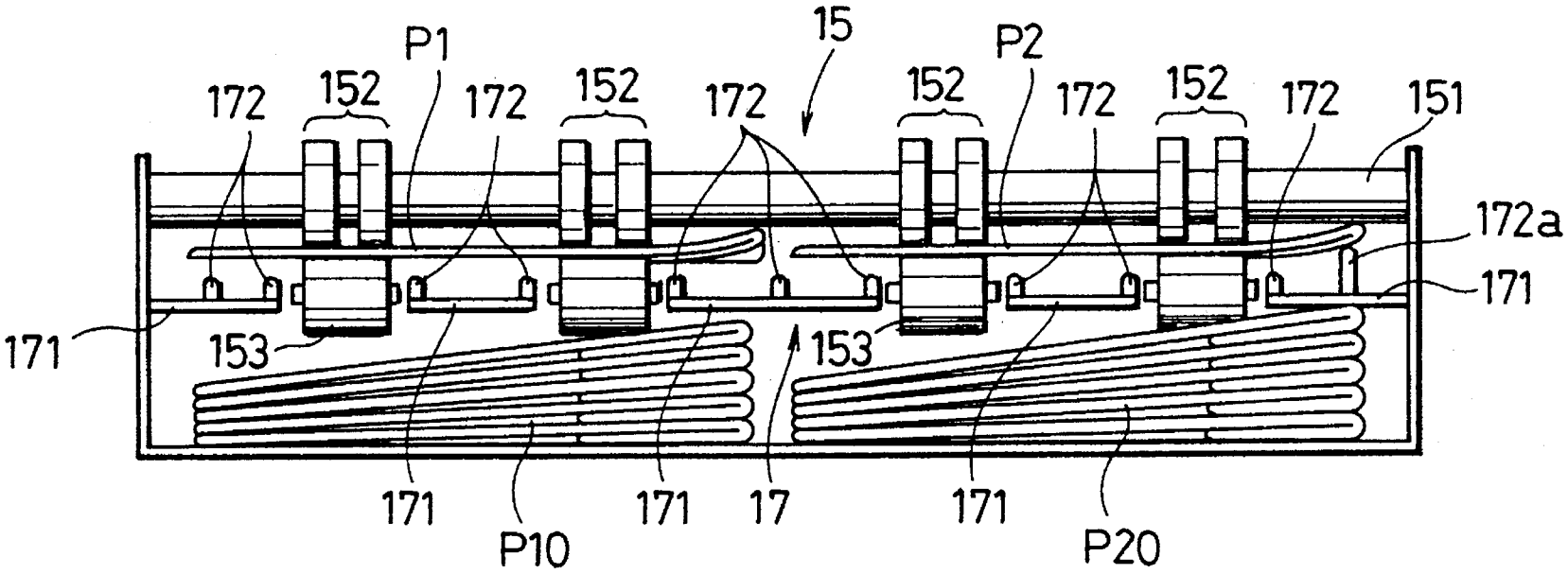
FIG. 6 is a diagram showing an exemplary detailed construction of a discharge roller device and a discharge guide when viewed from a stacking portion.

FIG. 6 is a diagram showing an exemplary detailed construction of the discharge roller device 15 and the discharge guide 17 when viewed from the stacking portion (discharge tray 20).

In this figure, the discharge roller device 15 includes discharge rollers 152 arranged in parallel at specified intervals on the drive shaft 151 and driven rollers 153 placed in notches formed in an unillustrated member, e.g. a horizontal flat plate, at specified internals in correspondence with the discharge rollers 152. The rollers 152, 153 are disposed at positions where the envelopes P1, P2 are transported so as to transport the same properly. The discharge guide 17 is provided between driven rollers 153. The discharge guide 17 includes base portions 171 and upright portions 172. An upright portion 172*a* is disposed at a position where the downward warped lateral edge of the turned-up portion 32 of the envelope P2 passes in the case of the FU discharge. The upright portion 172*a* is longer than the other upright portions 172. The tall upright portion 172*a* guides the envelope P2 to the discharge tray 20 while lifting forcibly the downward warped turned-up portion 32 as shown in FIG. 6, so that the envelope P2 does not collide with a stack of already discharged envelopes P20. In other words, the upright portion 172*a* serves as lifting means. The envelope P1 causes no problem even if it is discharged as it is, because the lateral edge of the turned-up portion 31 is warped upward as described above.

Figure 7:
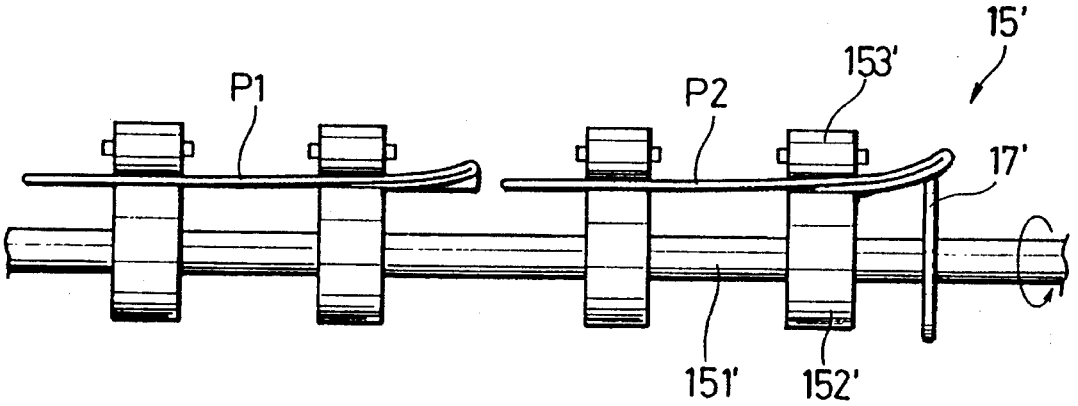
FIG. 7 is a diagram showing another embodiment of a discharge roller device and a discharge guide.

FIG. 7 shows another embodiment of a discharge roller device 15' and a discharge guide 17'. In this embodiment, drive side including a drive shaft 151' and discharge rollers 152' is located below driven rollers 153'. A discharge guide 17' having a diameter lager than that of the discharge rollers 152' is fixed or mounted rotatably on the drive shaft 151' at a position where the downward warped lateral edge of the turned-up portion 32 of the envelope P2 passes the case of the FU discharge. The discharge guide 17' having the large diameter guides the envelope P2 to the discharge tray 20 while lifting forcibly the downward warped turned-up portion 32 as shown in FIG. 6, so that the envelope P2 does not collide with a stack of already discharged envelopes P20.

In the case of the FD discharge, it is appropriate to provide at a position of the discharge roller device 16 such a discharge member as to lift forcibly the downward warped turned-up portion 31 of the envelope P1 while guiding the envelope P1 to the discharge tray 19.

As described above, according to the invention, a discharge guide is provided in a direction perpendicular to the transport direction of copy item and at a level of a discharge roller device after the fixing device. A portion of the discharge guide for guiding a turned-up portion of an envelope is formed to project higher than the position of the envelope being discharged in an opposite direction from a stacking portion. Accordingly, the likelihood can be obviated that the envelope being discharged comes to contact or collision with a stack of already discharged envelopes on the stacking portion, thereby enabling the envelopes to be stacked orderly and increasing a stacking amount of envelopes.

Although the present invention has been fully described by way of example with reference to the accompanying drawings, it is to be understood that various changes and modifications will be apparent to those skilled in the art. Therefore, unless otherwise such change and modifications depart from the scope of the invention they should be construed as being included therein.

What is claimed is:

1. A discharge device for use in an image forming apparatus including a fixing portion having a heating roller in the shape of a hyperboloid for fixing an image formed on an item and a stacking portion for stacking the item, the discharge device comprising:

discharge means provided between the fixing portion and the stacking portion and adapted for discharging the item to the stacking portion; and non-rotative preventing means juxtaposed to said discharge means and below the item being to be discharged, said non-rotative preventing means having a fixed upright portion extending above the level of the item being discharged and adapted for preventing the discharging item from warping downward.

2. A discharge device according to claim 1 wherein the image forming apparatus is capable of forming images on envelopes being transported parallel to each other at the same time, the envelope having a turned-up portion.

3. A discharge device for use in an image forming apparatus including a fixing portion having a heating roller in the shape of a hyperboloid for fixing an image formed on an item and a stacking portion for stacking the item, the discharge device comprising:

discharge means provided between the fixing portion and the stacking portion and adapted for discharging the item to the stacking portion;

preventing means provided near the discharge means and below the item being to be discharged and adapted for preventing the discharging item from warping downward, said preventing means including an upright portion extending above a level of the item being discharge, a guide base portion for guiding the item from said fixing portion to said discharge means, said guide base portion being connected with said upright portion, said guide base portion being formed with a plurality of spaces at a specified interval in a horizontal direction perpendicular to the item discharging direction; and said discharge means including:

a drive shaft disposed above said guide base portion in a direction perpendicular to the item discharging direction;

a plurality of drive rollers mounted on said drive shaft at the same interval as the spaces; and a plurality of driven rollers disposed in the spaces of said guide base portion respectively corresponding to the plurality of drive rollers.

4. A discharge device for use in an image forming apparatus including a fixing portion having a heating roller in the shape of a hyperboloid for fixing an image formed on an item and a stacking portion for stacking the item, the discharge device comprising:

discharge means provided between the fixing portion and the stacking portion and adapted for discharging the item to the stacking portion; and preventing means provided near the discharge means and below the item being to be discharge and adapted for preventing the discharging item from warping downward, said preventing means including an upright portion extending above a level of the item being discharged, a guide base portion being provided between said fixing portion and said discharge means, said guide base portion guiding the item from said fixing portion to said discharge means, said guide base portion being connected with said upright portion.

5. In an image forming apparatus, the combination comprising:

a fixing means for fixing an image formed on an item;

receiving means for receiving said item;

discharge means between said fixing means and said receiving means operable to receive said items from said fixing means and to discharge said items to said receiving means;

said discharge means including upper discharge roller means generally overlying lower discharge roller means, said upper discharge roller means having a lower portion; and non-rotative preventing means between said fixing means and said discharge means disposed to underlie the item passing from said fixing means to said discharge means, said non-rotative preventing means including a fixed engaging element disposed at an elevation higher than said lower portion of said upper discharge roller means, said fixed engaging element slidably engaging said item passing from said fixing means to said discharge means to prevent said item from warping downward.

6. In an image forming apparatus, the combination comprising:

a fixing means having a heating roller for fixing an image formed on an item;

stacking means for stacking said items;

discharge means between said fixing means and said stacking means operable to receive said items from said fixing means and to discharge said items to said stacking means;

said discharge means including upper discharge roller means generally overlying lower discharge roller means, said upper discharge roller means having an outer periphery, said upper discharge roller means having a vertical diameter intersecting said outer periphery at a bottom point of said outer periphery; and guiding means between said fixing means and said discharge means disposed to underlie the item passing from said fixing means to said discharge means, said guiding means having an engaging element disposed at an elevation higher than said bottom point on said outer periphery of said upper discharge roller means, said engaging element engaging said item passing from said fixing means to said discharge means to prevent said item from warping downward, said guiding means being non-rotatively disposed in a fixed position between said fixing means and said discharge means.

7. In an image forming apparatus, the combination comprising;

a fixing means having a heating roller for fixing an image formed on an item;

stacking means for stacking said items;

discharge means between said fixing means and said stacking means operable to receive said items from said fixing means and to discharge said items to said stacking means;

said discharge means including upper discharge roller means generally overlying lower discharge roller means, said upper discharge roller means having an outer periphery, said upper discharge roller means having a vertical diameter intersecting said outer periphery at a bottom point of said outer periphery; and guiding means between said fixing means and said discharge means disposed to underlie the item passing from said fixing means to said discharge means, said guiding means having an engaging element disposed at an elevation higher than said bottom point on said outer periphery of said upper discharge roller means, said engaging element engaging said item passing from said fixing means to said discharge means to prevent said item from warping downward, said engaging element being a fixed engaging element which is non-rotatively disposed in a fixed position near said discharge means, said fixed engaging element slidably engaging said item as said item passes from said fixing means to said discharge means.

8. In an image forming apparatus, the combination comprising;

a fixing means having a heating roller for fixing an image formed on an item;

stacking means for stacking said items;

discharge means between said fixing means and said stacking means operable to receive said items from said fixing means and to discharge said items to said stacking means;

said discharge means including upper discharge roller means generally overlying lower discharge roller means, said upper discharge roller means having an outer periphery, said upper discharge roller means having a vertical diameter intersecting said outer periphery at a bottom point of said outer periphery; and guiding means between said fixing means and said discharge means disposed to underlie the item passing from said fixing means to said discharge means, said guiding means having an engaging element disposed at an elevation higher than said bottom point on said outer periphery of said upper discharge roller means, said engaging element engaging said item passing from said fixing means to said discharge means to prevent said item from warping downward, said guiding means comprising a base portion and upright parts extending upwardly from said base portion, one of said upright parts extending higher from said base portion than the remaining upright parts, said one upright part constituting said engaging element.

* * * * *